US007651170B2

(12) United States Patent
Davies

(10) Patent No.: US 7,651,170 B2
(45) Date of Patent: Jan. 26, 2010

(54) BORE HEAD FOR MICROBORE OPERATION

(76) Inventor: Rodney John Davies, 47 Brunel Road, Seaford, Victoria 3198 (AU)

( * ) Notice: Subject to any disclaimer, the term of this patent is extended or adjusted under 35 U.S.C. 154(b) by 82 days.

(21) Appl. No.: 11/961,007

(22) Filed: Dec. 20, 2007

(65) Prior Publication Data

US 2008/0099248 A1 May 1, 2008

Related U.S. Application Data

(63) Continuation-in-part of application No. 11/566,306, filed on Dec. 4, 2006, now Pat. No. 7,510,025, which is a continuation-in-part of application No. 10/622,710, filed on Jul. 18, 2003, now abandoned.

(30) Foreign Application Priority Data

Dec. 20, 2006 (AU) ..... 2006907085

(51) Int. Cl.
*E21D 9/10* (2006.01)
*E21B 10/60* (2006.01)

(52) U.S. Cl. ..... 299/1.3; 299/1.8; 299/58; 175/26; 405/142; 405/143

(58) Field of Classification Search ..... 175/26, 175/45; 299/81.2, 1.3, 1.8, 55, 58; 405/142, 405/143

See application file for complete search history.

(56) References Cited

U.S. PATENT DOCUMENTS 1,026,412 A * 5/1912 Stone ..... 299/31
3,005,627 A * 10/1961 Tinlin ..... 299/56
3,321,248 A * 5/1967 Williamson et al. ..... 299/1.3
3,635,108 A * 1/1972 Prince ..... 33/286
3,707,330 A * 12/1972 Pine ..... 356/153
3,778,107 A * 12/1973 Haspert ..... 299/11
3,799,615 A * 3/1974 Taylor et al. ..... 299/59
4,023,861 A * 5/1977 Schnell ..... 299/1.8
4,027,210 A * 5/1977 Weber ..... 318/16
4,122,683 A * 10/1978 Follert et al. ..... 405/142
4,420,188 A * 12/1983 Robbins et al. ..... 299/31
4,494,617 A * 1/1985 Snyder ..... 175/86
4,506,745 A * 3/1985 Bjor ..... 175/45
4,508,390 A * 4/1985 Bessac ..... 299/33
4,556,256 A * 12/1985 Follert et al. ..... 299/33
4,576,515 A * 3/1986 Morimoto et al. ..... 405/184
4,655,493 A * 4/1987 Sumi ..... 299/33
5,061,120 A * 10/1991 Akesaka ..... 405/143
5,076,729 A * 12/1991 Grotenhofer ..... 405/146

(Continued)

*Primary Examiner*—Shane Bomar
(74) *Attorney, Agent, or Firm*—Chernoff, Vilhauer, McClung & Stenzel, LLP

(57) ABSTRACT

Boring apparatus for drilling laser guided microbore tunnels uses a liquid stream to remove soil as slurry and an airstream to conduct the slurry away from the bore head. The cylindrical head houses a drill shaft steered by a pair of remotely controlled rams according to the position of a laser spot on a target fixed close to the end of the drill shaft. Small arcuate steering movements shift the cutter up and down through a first ram alongside the shaft working through a linkage. Side to side steering is provided by a second ram acting directly on the shaft. The components are mounted on an axial base wall which gives repair access and camera view of the target. A drilling platform has rams for advancing the cylindrical head.

10 Claims, 5 Drawing Sheets

U.S. PATENT DOCUMENTS 5,099,927 A * 3/1992 Gibson et al. ..... 175/45
5,133,418 A * 7/1992 Gibson et al. ..... 175/45
5,156,490 A * 10/1992 Terasawa ..... 405/141
5,172,764 A * 12/1992 Hajali et al. ..... 166/267
5,236,284 A * 8/1993 Ilomaki ..... 405/143
5,296,915 A * 3/1994 Akesaka ..... 356/400
5,361,854 A * 11/1994 Tull et al. ..... 175/45
5,470,132 A * 11/1995 Cartwright ..... 299/56
5,501,548 A * 3/1996 Hayashi et al. ..... 405/143
5,529,437 A * 6/1996 Filipowski et al. ..... 405/143
5,890,771 A * 4/1999 Cass ..... 299/31
5,938,288 A * 8/1999 Saint-Pierre et al. ..... 299/1.4
6,017,095 A * 1/2000 DiMillo ..... 299/56
6,131,676 A * 10/2000 Friant et al. ..... 175/371
6,332,652 B1 * 12/2001 Nakakuro ..... 299/55
6,470,605 B1 * 10/2002 Gilman et al. ..... 37/323
7,073,869 B2 * 7/2006 Nakakuro ..... 299/81.3
2006/0102565 A1 * 5/2006 Alford ..... 210/770

* cited by examiner

BORE HEAD FOR MICROBORE OPERATION

CROSS-REFERENCE TO RELATED APPLICATION(S)

This application is a continuation-in-part of U.S. patent application Ser. No. 11/566,306 filed Dec. 4, 2006, now U.S. Pat. No. 7,510,025 which is a continuation-in-part of U.S. patent application Ser. No. 10/622,710 filed Jul. 18, 2003, now abandoned the entire disclosure of each of which is hereby incorporated by reference herein for all purposes.

FIELD OF THE INVENTION

This invention concerns apparatus for drilling laser guided microbore tunnels and particularly a bore head for such apparatus.

BACKGROUND OF THE INVENTION

In our application Ser. No. 11/566,306 being a c-i-p of Ser. No. 10/622,710, we describe microbore operations which create horizontal bores 2-6 m below ground for the introduction of pipes from 300-600 mm in diameter. These bring services such as sewerage, mains water, mains gas and the like to buildings where the runs are short but perhaps crowded such as suburban housing or industrial estates.

The operation is preceded by the selection of an on-ground direction between two sites. A pit is excavated at each site and a laser is used to indicate the direction below ground level. Inclination of the beam then follows to ensure appropriate fall. Meanwhile a concrete base is cast on the pit floor or timbers are laid and the pit wall which is to receive the bore is faced with concrete and a circular aperture is formed in the wall using a plug.

The drilling platform is lowered on to the base and a target on the shaft of the bore head and platform are aligned as a unit with the laser spot. The platform is secured in the pit using peripheral jacks and the ancillary services such as hydraulic power and mains water and vacuum operation are brought to the pit.

The specification proposes various improvements to the equipment. In our co-pending Australian Application No. 2006907085 we describe ancillary equipment with which the platform and bore head of this invention are intended to be used.

In our Australian Patent No. 2003262292 we describe a bore head in which a pair of rams disposed radially at 90° to each other. These are attached to the cylindrical wall of the bore head and are grouped at the leading end in order to provide the requisite steering movement, namely 15 mm either side of centre, while it would be preferable to place the target as close to the cutter as possible to give to the operator the truest possible picture of the drilling axis, the rams prevent this and the target therefore placed in front of the rams. While the operator had a good view of the laser spot on the target, the adjustment of the drilling axis would frequently result in oversteer.

SUMMARY OF THE INVENTION

This invention concerns a boring head for laser guided drilling microbore tunnels using a liquid stream to remove soil, and an airstream to remove the soil and liquid mix, comprising a substantially cylindrical body with a leading end wall and a trailing end wall, an axial wall dividing the body into a component compartment and a flow compartment, the component compartment housing a steerable boring shaft which projects through the leading end wall to support a cutter a shaft bearing fixed to the axial wall near the trailing end, a liquid path through at least part of the shaft which exits beyond the leading end wall, a laser target mounted on the shaft close to the leading end wall and the cutter, and a camera mounted on the axial wall for shooting the target, the shaft being steered by rams mounted on the axial wall and acting at 90° to each other, up and down steering being provided by a first ram acting substantially parallel to the shaft and side to side steering being provided by a second ram acting transversely to the shaft, a passage through the flow compartment for liquid and air mix, a passage through the flow compartment for air.

The bearing may be a thrust bearing and the bearing housing may be bolted to the base. This housing may have an inlet which connects to the incoming water supply to form the slurry and an outlet which feeds water to the shaft interior. The ram mounts may be frames of inverted U-shape fixed to the base. The valve components which supply fluid to the rams may be arranged alongside the shaft so as to be accessible for servicing. Similarly the camera may be mounted on a stand fixed to the base.

When the components are grouped on a base, the attendant pipes and cables are easier to route and keep out of the way of the laser beam which must hit the target fixed to the shaft near the leading end thereof.

The end walls of the head may be semi-circular having a circular central major passage for return air and slurry and two minor passages parallel thereto of a cross-section which in total exceeds the cross-section of the major passage.

The central vacuum passage preferably ends in a coupling capable of connection to a pipe string which extends along the bore to the platform part and thence to the vacuum tank above the pit.

The bore head may be prepared for use by attaching to the base a semi-cylindrical cover with semi-circular end walls. The cover is removable for cleaning and servicing.

The bore head may be pushed by a carriage riding on a platform and may take drive from a motor mounted in the carriage in known manner.

The platform may have a pair of polished rails and the carriage may have a pair of slides for engaging the rails. The slides may each have a groove therein of keyhole section adapted to partially encompass the rail and minimise the lost motion.

The platform may have a pair of ram assemblies for advancing and retracting the carriage, each assembly comprising a pair of ganged rams, one extending in the bore direction and one in the reverse direction.

The drive from the motor to the bore head may include a universal coupling. The coupling is preferably sited close to the carriage. A universal coupling inside the bore head allows the cutter shaft to waggle and respond to steering forces selected by the operator.

The drive output from the motor may include a socket for receiving the ends of the rods which compose the string and the socket is spring loaded. This facilitates the coupling and uncoupling of the drill rods which is ongoing throughout the drilling operation.

BRIEF DESCRIPTION OF THE DRAWINGS

One embodiment of the invention is now described by way of example with reference to the accompanying drawings, in which.

DETAILED DESCRIPTION

Platform

Figure 1:
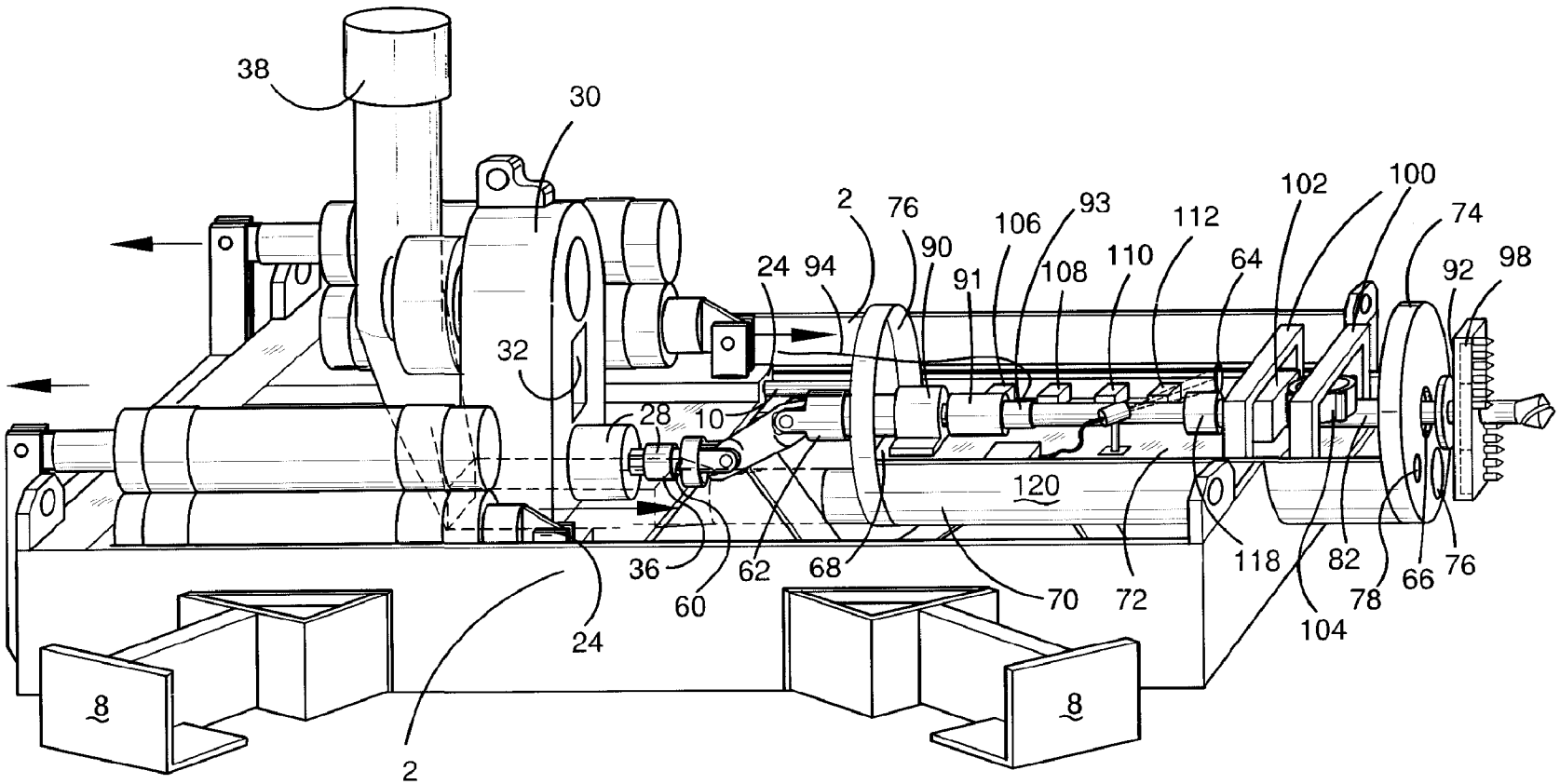
FIG. 1 is a perspective of the platform and bore head with the cover removed for clarity.
Figure 2:
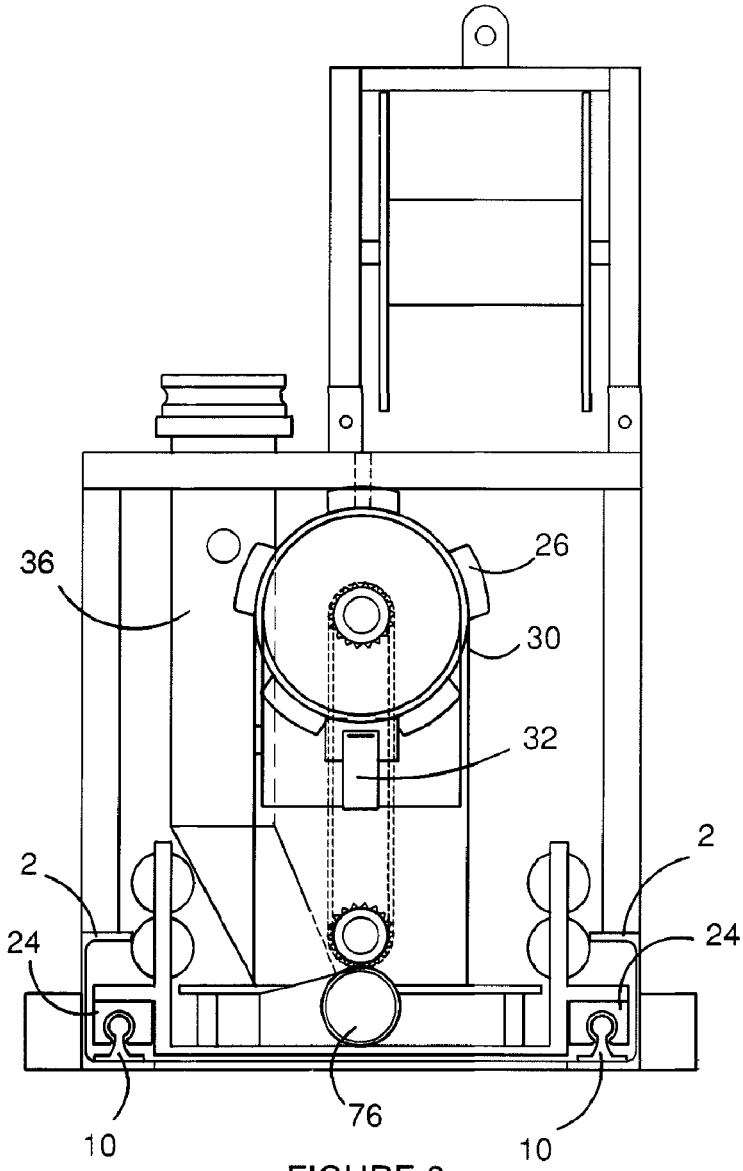
FIG. 2 is an end view of the platform including the reel looking towards the bore.

Referring now to the drawings, especially FIGS. 1 and 2, the platform bearers 2 are mutually connected by zig zag ties 4. The bearers are of C-shaped cross-section and are directionally positioned in the pit 6 by L-section thrusters 8. The bearers each support a stainless steel rail 10 of keyhole section. Carriage 12 extends across the width of the platform with a floor 14 on which is mounted a hydraulic drive assembly 16.

The front end of the carriage has an upstanding pair of brackets 18. A corresponding pair of brackets 20 extends from the rear of the platform. The cylinders of a pair of carriage rams 22 are connected side by side to the carriage. The connecting rods point in mutually opposite directions and react against brackets 18 and 20 thereby doubling the stroke of the rams. The platform rides on slides 24 (FIG. 2) which embrace the rails and ensure accurate linear motion.

The drive assembly comprises hydraulic motor 26 which delivers rotation to coupling 28 through drive guard 30. The guard 30 has laser window 32 through which laser generator 34 directs a beam. Beneath coupling 28 is vacuum spigot 36 which projects towards the bore. Spigot 36 leads to vertical, rigid vacuum tube 38 to which a flexible vacuum tube (not shown) is attached. The flexible tube carries drilling slurry to ancillary apparatus described in co-pending Application No. 2006907085.

The water from the slurry is obtained from an onsite piped supply. It is brought into the pit by a hose (not shown) which is coiled on reel 40 mounted above the drive assembly. As the drilling proceeds, the hose pays out and follows the boring head.

The drive coupling 28 has a spring loaded hexagonal socket 60 which can be displaced by an operator when inserting an extra drill rod. The drill string works in the same way as described in Australian Patent No. 2003262292. A universal coupling 62 takes drive from the carriage to the bore head.

The laser is directionally adjusted and then its inclination is adjusted to give appropriate fall. The platform is aimed by adjusting screw jack thrusters 8 until the laser beam strikes the centre of the target 64 in the bore head which is next described.

Bore Head

The bore head has a circular leading wall 66 and a trailing semi-circular wall 68. A semi cylindrical body 70 made of sheet metal has a flat rectangular floor 72 upon which components are mounted. These are closed in by a semi cylindrical cover (not shown) which is secured to flanges 74 extending from walls 66 and 68.

Body 70 is hollow but central tube 76 is 5 inches across (100 mm) and conducts air and slurry rearwardly while air supply tubes 78, 80 allow air from the bore to pass through the walls 66, 68 which would otherwise be a barrier. End walls 66, 68 also contain shaft apertures for the cutter shaft 82 which extends through the bore head to the end of the drill string. The drill string in turn is driven by coupling 28.

A thrust bearing housing 90 is bolted to the floor 72. The cutter shaft 82 reacts against the thrust bearing. Universal coupling 92 allows the shaft to waggle up to 30 mm. The leading end carries cutter 94. The cutter shaft is hollow from the universal coupling forwards and the leading end of the cutter shaft is surrounded by sleeve 96 (see FIG. 3) which is connected by inlet 98 to the external water supply pipe at the reel 40. The shaft interior communicates with passages 100 in the cutter and water sparges from the cutter.

Steering Rams

A pair of inverted U-shaped mounts 102 are welded to the floor behind the leading end wall 68. Each supports a ram 104, 106 which acts on a sleeve which is a slide fit on shaft 82. Rams 104, 106 are disposed at 90° to each other and both are fed by mains pressure water via solenoid operated valves 108, 110, 112, 114 as described in Australian Patent No. 2003262292. Both ends of the ram are connected to either feed or drain. The drained water leaving the rams is dumped into the slurry exit tube 76.

The valves mounted on floor 72 are connected to the rams by flexible tubes 116. A collar 118 on the shaft 82 supports target 64 marked with concentric rings. The target is viewed through a video camera 120 which supplies an image to a monitor located in the pit. The head is steered by draining water from one or both rams to bring the centre of the target to the static spot of laser light.

The ram stroke is 15 mm and partial stroke movement suffices to correct deviation in drilling. If the soil is uniform and not unduly stony, steering corrections may not be required for several minutes.

The space behind the cutter between the cutter and the leading wall 66 is purged of soil and water by the constant vacuum. When the bore has reached maximum distance which is about 120 m, the carriage is again reciprocated but upon each retraction the section of drill string and a length of vacuum tube is removed as a unit from the pit and the bore head emerges into the pit.

The platform and head are lifted out of the pit, reversed and lowered into the pit so that drilling can proceed in the opposite direction. When the bore links the two selected sites, a pipe of suitable diameter is inserted and the gap between the pipe and the bore is filled with a hardenable construction mix in which the buoyant air-filled pipe floats.

Figure 4:
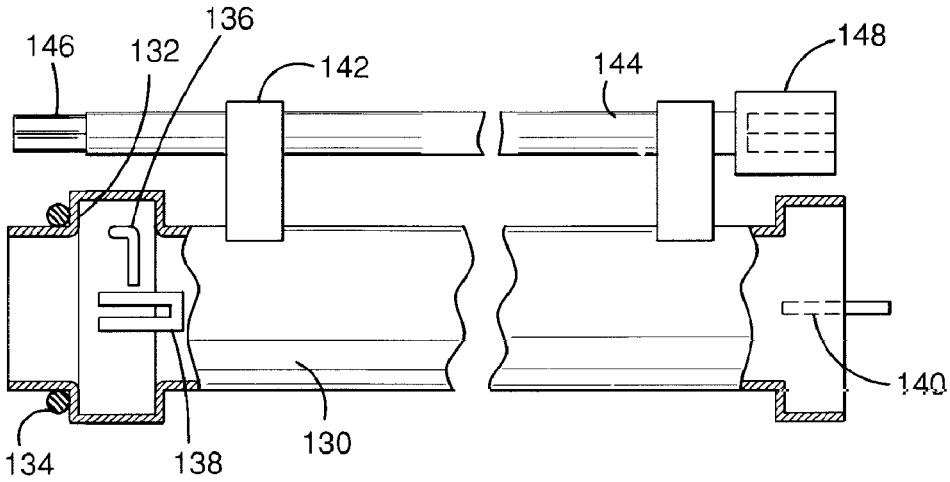
FIG. 4 is a partial section of the drill rod.

Referring now to FIGS. 1 and 4, during drilling the bore head progresses by the insertion of a drill rod assembly between the coupling 28 on the universal coupling 62 and the bore head.

Figure 3:
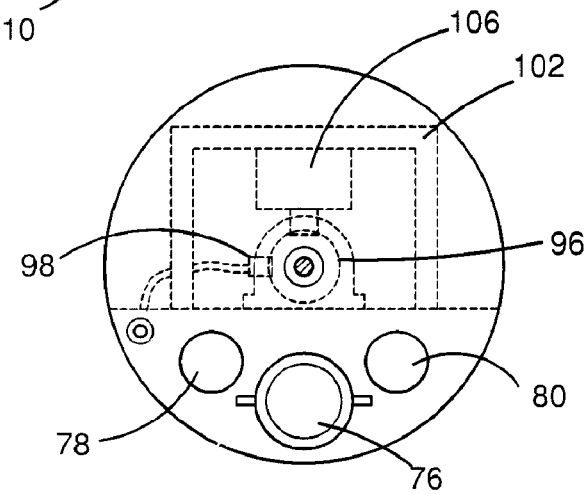
FIG. 3 is an end view of the bore head showing the passages.

An assembly is shown in FIG. 3 and consists of a steel tube 130 with the same diameter as the central tube 76. The ends of the tube are constructed for coaxial overlap and the drilling thrust is transmitted by the annular wall 132 rendered gas light by rubber o-ring 134. The assemblies once engaged are locked together by pins 136 inserted into interfitting flanges 138, 140. Brackets 142 hold bearings which support a solid steel drive shaft 144 with a male hexagon socket 146 at one end and a female socket 148 at the opposite end. Pins 136 keep the string connected when the thruster reverses and pulls the bore head out of the bore. The carriage applies thrust through tube 130. Drive shafts 144 bear no thrust.

Figure 5:
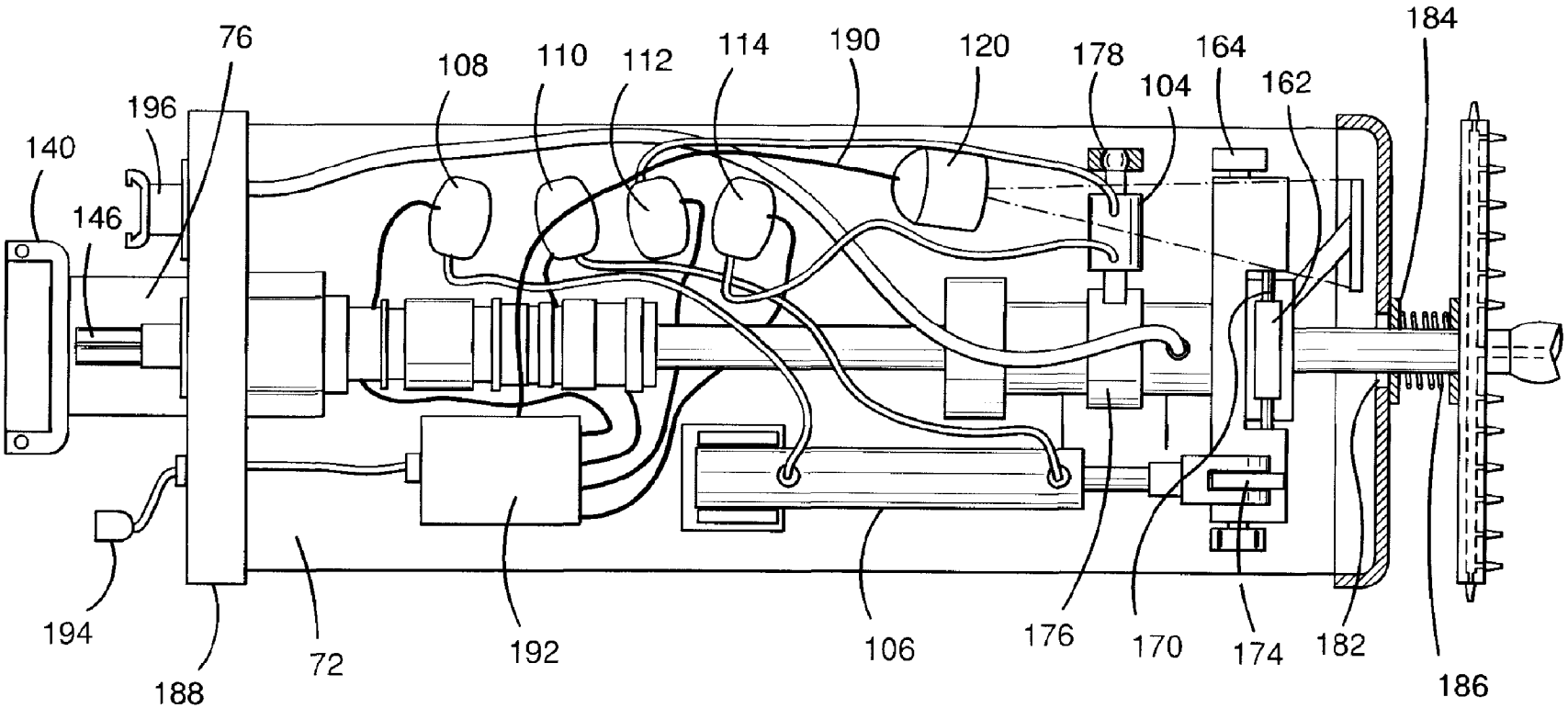
FIG. 5 is a plan view of variant of the bore head.
Figure 6:
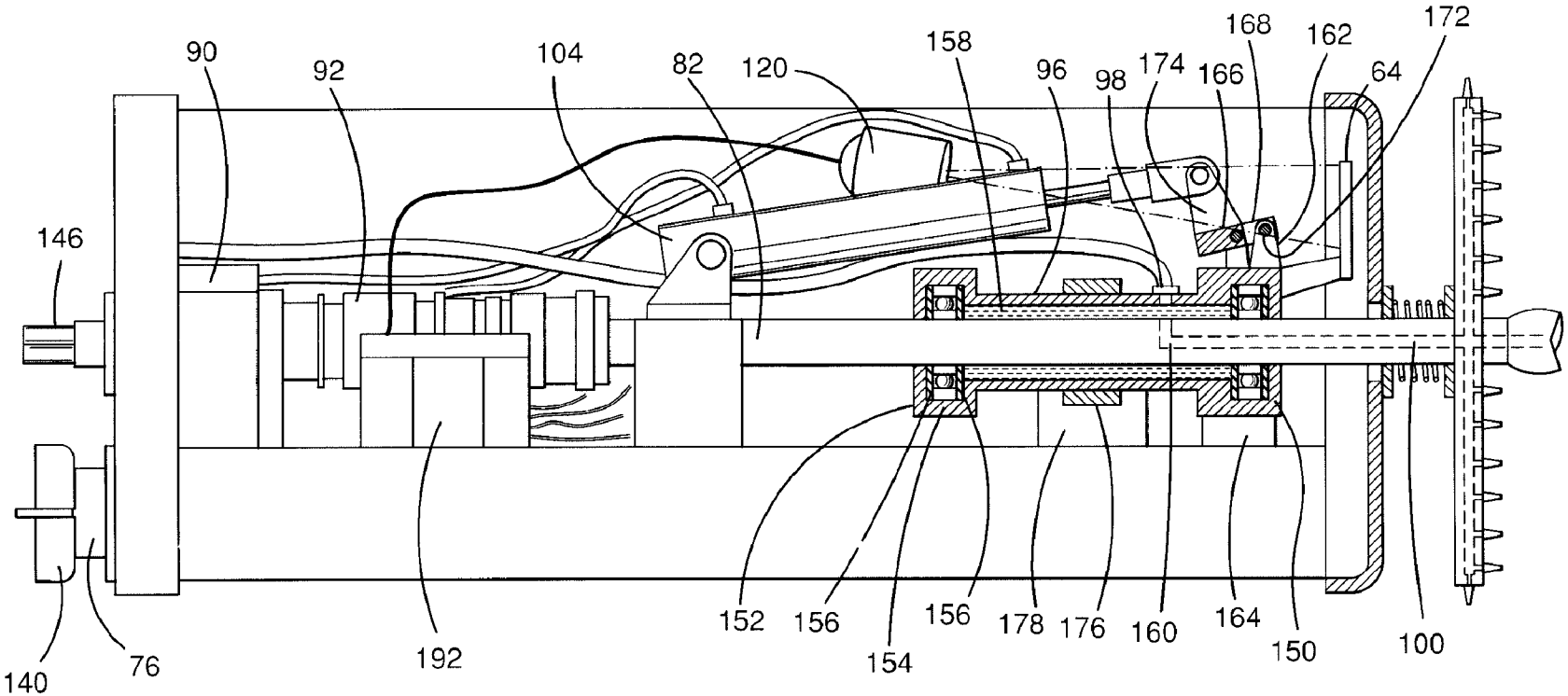
FIG. 6 is a side view of the variant of the bore head of FIG. 4.

FIGS. 4 and 5 show a variant which utilises the base to greater advantage. The thrust bearing 90, universal coupling 92, shaft 82 and cutter are arranged as in FIG. 1 and the shaft is free to waggle in an arc of about 30 mm. The steering rams are modified to allow the target 64 to be as close to the cutter as possible. The leading end of the shaft 82 passes through sleeve 96 which conducts water into the hollow centre of the shaft. The sleeve has a leading boss 150 and a trailing boss 152, each of which contain a bearing 154 so that the sleeve remains static while the shaft 82 rotates. Each bearing is accommodated between a pair of seals 156 and the sleeve between the bosses acts as a water jacket 158 fed by port 98 from the water supply pipe.

The shaft has a central water bore 100 which allows water to reach the cutter 94. A radial port 160 connects the water passage to the jacket. The leading boss 150 has an upwardly projecting lug 162.

The mechanism from which the sleeve 96 depends is next described.

A pair of trunnions 164 disposed at the leading end at 90° to the shaft axis support a yoke 166 made of flat steel bar. The central position has a cut out 168 which is spanned by a rod 170. The rod is a slide fit in the bore 172 of the upwardly projecting lug 162. An arm 174 extends at 90° from the yoke and first ram 106 actuates the yoke like a bell crank, causing the shaft to move up and down in a small steering arc. Even so it is necessary to fit the rod in the yoke with flexible inserts to allow slight rocking of the rod. This prevents binding and leads to smooth steering.

The central part of the jacket 158 is surrounded by a metal collar 176. Side to side steering is provided by the second ram 104 which reacts against post 178 and the collar 176 on the shaft. A spherical bearing (not shown) connects the ram to the post to permit up and down motion in the shaft of the order of 2-5 mm. The sideways steer motion is the same extent as the up and down motion.

The shaft itself is made of a stainless steel alloy whose surface is chromed. The shaft projects through the waggle aperture 182 which is kept shut against the ingress of slurry by steel washer 184 urged against the end wall by spring 186.

Semi-circular hoops 188 extend over the hose for the reception of a semi-cylindrical steel cover plate. Removal of the cover is all that is necessary to render all the components accessible for inspection, cleaning and repair.

The camera 120 has ample room and an unobstructed view of the target 64. The lens is forwardly facing and the cross wires of the target are removably facing and neither become dirty despite the passage of water continually through the conduits to the rams and through the shaft to the cutter head, the movement of the base head through sandy soil and the flow of slurry through the flow passages. The 24 v cables for the solenoid operated valves 108-114 and the camera cable 190 enter terminal box 192 and exit in an electrical socket 194. Water enters the head at mains pressure through union 196.

Figure 7:
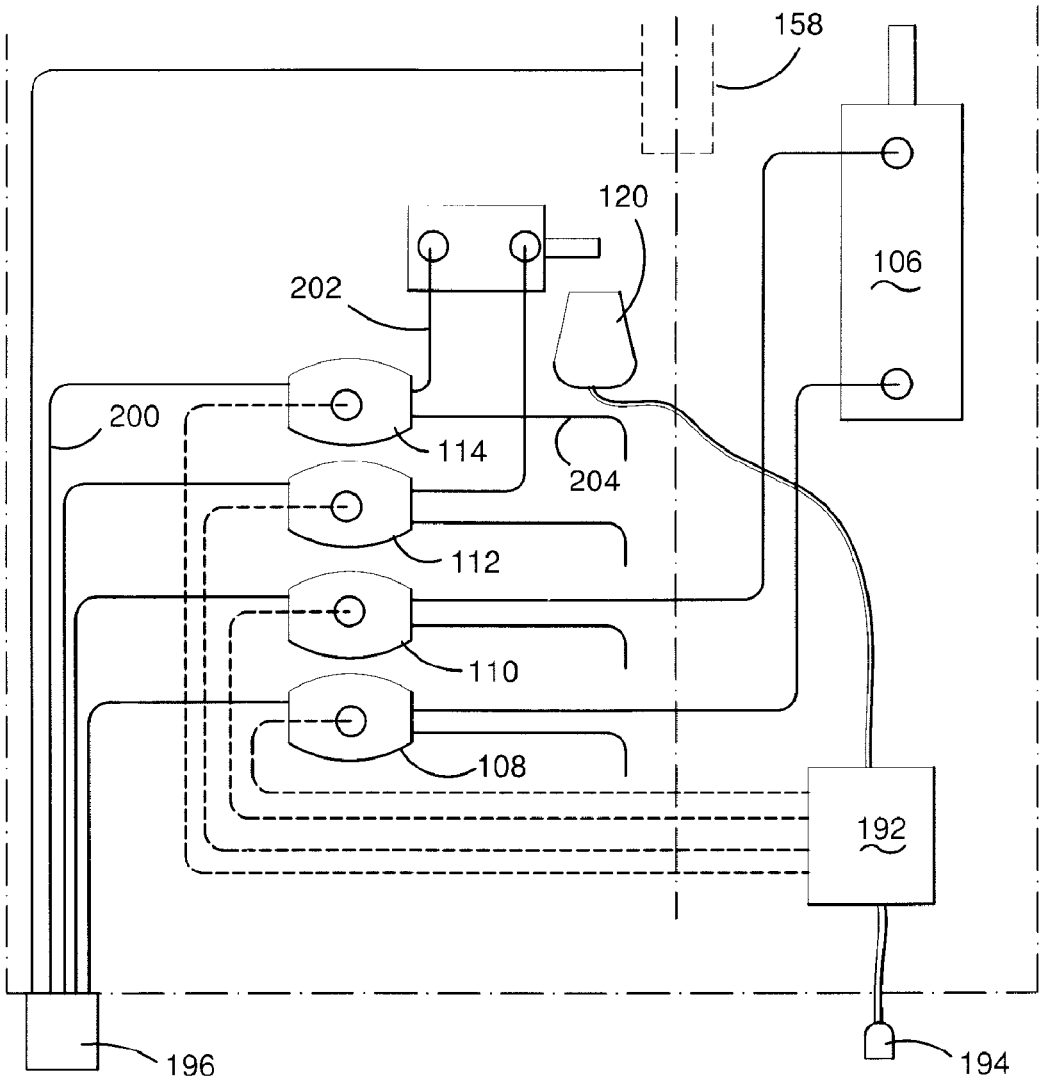
FIG. 7 is a schematic showing the hydraulic and electrical pathways.

The arrangement of the tubes and leads is seen in the schematic shown in FIG. 7. Union 196 on the trailing wall 68 of the bore head delivers mains water to the water jacket 158 and to each of the four valves 108-114 mounted on the base. Each valve has a water inlet 200, a water outlet 202, and a water drain 204. The drain passes through the base and discharges into the slurry tube 76.

Both ends of the ram are subjected to mains pressure. The solenoid control in the valve connects the selected end to drain and the piston moves in the desired direction. Leads 206 conduct 24v dc to the solenoids from terminal box 192. Socket 194 which receives the plug of a cable which is fed through the bore following behind the bore head. Camera 120 is connected to the same terminal box.

We have found the advantages of the above embodiment to be:

1. Placing the laser target as close as possible to the cutter cures oversteer, and permits stable direction for the bore head. It is possible in suitable ground to drill for five drill rod lengths without steering correction.

2. Long drill runs are achievable without malfunction or damage to the bore head.

3. Cleanliness in the components compartment means that the operator can always have a clear image of the target.

4. The arrangement of the rams in the variant described allows the diameter of the bore to be reduced to mm.

What is claimed is:

1. A boring apparatus for drilling laser guided microbore tunnels using a liquid stream to remove soil and an airstream to remove the soil and liquid mix created by the liquid stream, the boring apparatus having a bore head comprising:

a substantially cylindrical body with a leading end wall and a trailing end wall, an axial wall dividing the body into a component compartment and a flow compartment, a passage through the flow compartment for liquid and soil mix, a passage through the flow compartment for air, the component compartment housing a steerable boring shaft which projects through the leading end wall to support a cutter, a shaft bearing fixed to the axial wall near the trailing end, a liquid path through at least part of the shaft which exits beyond the leading end wall, a laser target mounted on the shaft close to the leading end wall and the cutter and a camera mounted on the axial wall for shooting the target, the shaft being steered by rams mounted on the axial wall and acting at 90° to each other, up and down steering being provided by a first ram acting substantially parallel to the shaft and side to side steering being provided by a second ram acting transversely to the shaft.

2. A boring apparatus as claimed in claim 1, wherein, the shaft has an external surface which is partially enclosed by a water jacket having a leading end and a trailing end, each end accommodating a shaft bearing, whereby the jacket remains static while the shaft rotates and at least one water seal protects the bearing, the shaft having a water passage leading to the cutter for creating slurry and a radial inlet connecting the water passage to the water jacket, the leading end of the jacket having linkage to the first ram, whereby both jacket and shaft are moved up and down during steering.

3. A boring apparatus as claimed in claim 2, wherein the target is mounted on the leading end of the water jacket.

4. A boring apparatus as claimed in claim 2, wherein the water jacket has a collar lying intermediate the two ends, the first ram actuates a bell crank supported on the base and the bell crank is connected to the collar by the linkage which permits transverse steering of the shaft by the second ram.

5. A boring apparatus as claimed in claim 4, wherein the linkage further comprises a yoke which extends transversely across the axis of the shaft and a rod supported by the yoke, the rod being engaged by a projection of the collar which is free to slide on the rod as the shaft is steered from side to side.

6. A boring apparatus as claimed in claim 1, wherein the bore head is driven by an actuator comprising, a platform with rails for reciprocating the bore head, a carriage mounted on the rails, a motor for rotating the cutter, and a pair of ram assemblies for advancing and retracting the carriage, each assembly further comprising a pair of ganged rams, one extending in the bore direction and one in the reverse direction.

7. A boring apparatus as claimed in claim 6, wherein the ganged rams lie side by side and are joined, whereby the ganged rams are augmented in stroke relative to the rams individually.

8. A boring apparatus as claimed in claim 6, wherein the carriage has slides which engage the rails and both are of complementary interlocking section.

9. A boring apparatus as claimed in claim 6, wherein the carriage supports a reel for winding in and winding out conduit which services the boring head.

10. A boring apparatus as claimed in claim 1, wherein the liquid and soil mix passage is substantially central in the flow compartment and the air passage is divided into two conduits flanking the liquid and air mix passage.

* * * * *